US006779714B2

(12) United States Patent
Webb

(10) Patent No.: US 6,779,714 B2
(45) Date of Patent: Aug. 24, 2004

(54) BIOLOGICALLY SAFE MAIL BOX

(75) Inventor: Winston S. Webb, Largo, FL (US)

(73) Assignee: Honeywell International Inc., Morristown, NJ (US)

( * ) Notice: Subject to any disclaimer, the term of this patent is extended or adjusted under 35 U.S.C. 154(b) by 46 days.

(21) Appl. No.: 10/284,079

(22) Filed: Oct. 29, 2002

(65) Prior Publication Data

US 2004/0020978 A1 Feb. 5, 2004

Related U.S. Application Data

(60) Provisional application No. 60/351,290, filed on Oct. 29, 2001.

(51) Int. Cl.[7] ..... B65D 91/00

(52) U.S. Cl. ..... 232/17; 232/34; 340/569; 422/24

(58) Field of Search ..... 232/17, 34, 45; 34/275; 422/24, 186.3; 250/492.1, 455.11; 426/248; 340/569

(56) References Cited

U.S. PATENT DOCUMENTS

| | | | | | |
|---|---|---|---|---|---|
| 4,067,691 | A | * | 1/1978 | McGady et al. | 422/1 |
| 5,337,581 | A | * | 8/1994 | Lott | 62/264 |
| 5,369,892 | A | * | 12/1994 | Dhaemers | 34/275 |
| 5,446,289 | A | * | 8/1995 | Shodeen et al. | 250/455.11 |
| 5,498,394 | A | * | 3/1996 | Matschke | 422/24 |
| 5,546,678 | A | * | 8/1996 | Dhaemers | 34/275 |
| 5,629,527 | A | * | 5/1997 | Levitt et al. | 250/455.11 |
| 5,979,472 | A | * | 11/1999 | Lowery et al. | 134/58 R |
| 6,165,526 | A | * | 12/2000 | Newman | 426/248 |
| 6,365,113 | B1 | * | 4/2002 | Roberts | 422/186.3 |
| 6,497,840 | B1 | * | 12/2002 | Palestro et al. | 422/24 |

* cited by examiner

*Primary Examiner*—William L. Miller
(74) *Attorney, Agent, or Firm*—Ingrassia Fisher & Lorenz

(57) ABSTRACT

A mailbox contains a UV lamp to produce UV and ozone. The lamp is activated when the mailbox door is closed to destroy biological materials in the mail box.

11 Claims, 4 Drawing Sheets

BIOLOGICALLY SAFE MAIL BOX

This application claims priority from provisional application 60/351,290 filed Oct. 29, 2001.

BACKGROUND

The biological attack using mail showed that letters can be contaminated as they move through the postal system and come in contact with contaminated letters, sorting equipment, delivery trucks, mail boxes and the postman's mail bag. Decontamination in post offices does not do much to guard against subsequent recontamination before final delivery to an individual's mail box.

SUMMARY

According to the invention, mail is decontaminated in an individual's mail box. When the mail box door is closed, the door is locked and a decontamination process is started, for instance by activating a UV light source producing UV and ozone. The door unlocks once the decontamination process has run for a prescribed time sufficient to destroy any biological organisms.

According to an aspect of the invention, the process can start after an adjustable delay after the door is closed and locked. Lamps can be activate to indicate process stages and errors. The process can be started manually if necessary by external switches. Interlock switches can detect that the door position to prevent the process from starting if the door is not fully closed or stop the process if the door is opened. A microcontroller can control the process.

Other aspects and features of the invention will be apparent from the following description.

DESCRIPTION

Figure 1:
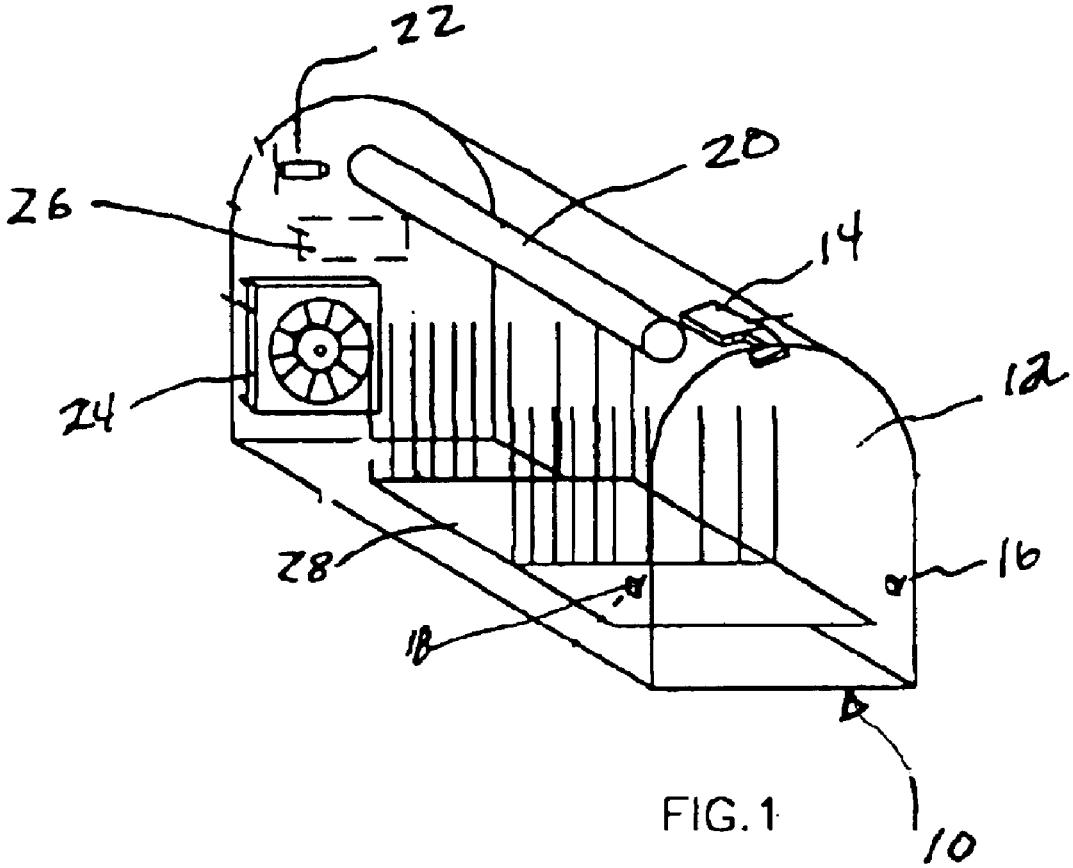
FIG. 1 shows a mailbox embodying the present invention.

Referring to FIG. 1, a conventional mailbox 10 contains a door 12 and an electronically controlled door lock 14. Though not visible, a seal or gasket between the door and the box to provides an airtight enclosure. A door safety switch 16 and a process start switch 18 are responsive to the opening and closing of the door 12. An ultra violet lamp 20, ultra violet lamp optical sensor 22, cooling fan 24 and control box 26 are located in and the box's interior with a mail rack 28.

Figure 2:
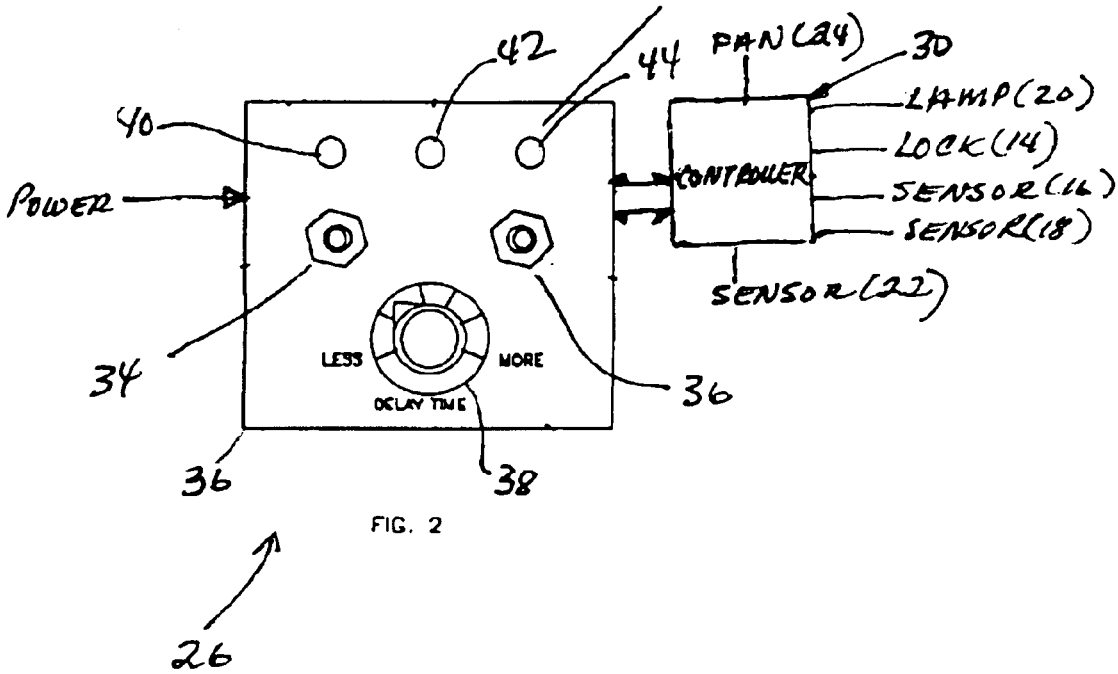
FIG. 2 shows a block diagram showing control panel and controller to carry out the invention.

Referring to FIG. 2, a microcontroller 30 is connected to the fan 24, lamp 20, electromechanical lock 14, and the sensors 16, 18 and 22. A control panel 32 is located on the rear outside surface of the box, receives system power and is connected to the microcontroller. The panel 32, providing an external interface, contains a manual start switch 34, manual stop switch 36, a delay time adjustment knob 38, a lamp 40, activated when the power is on, a lamp 42 to show the status of the system (a failure) and a lamp 44, activated to show that the decontamination process is taking place.

Figure 3:
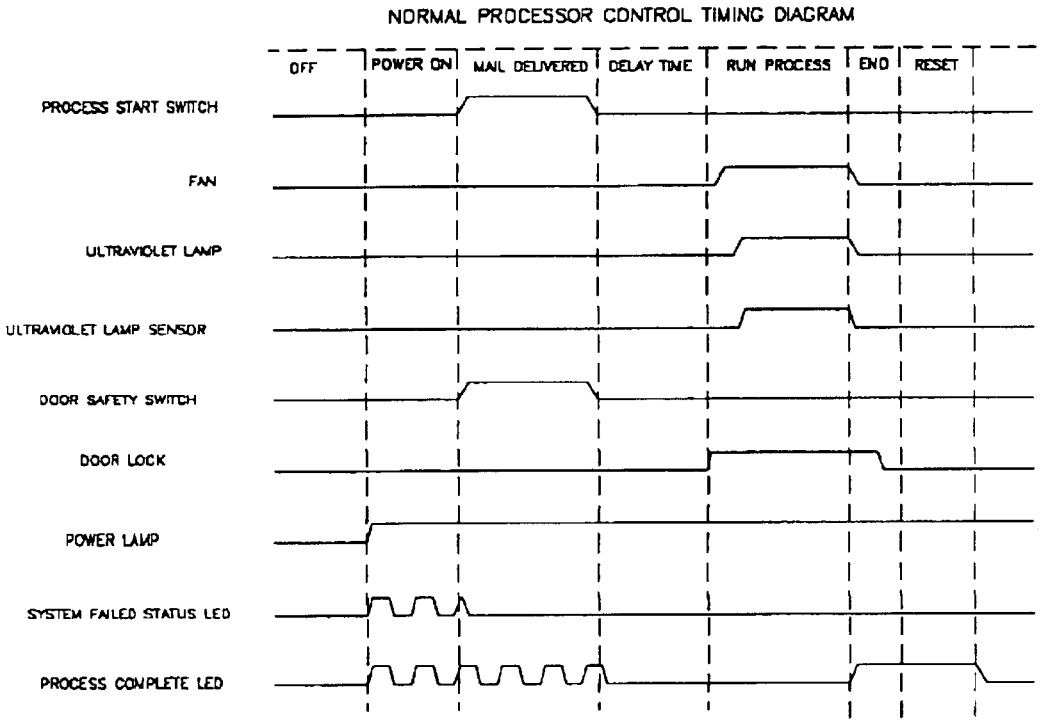
FIG. 3 is a timing diagram showing the automatic or normal decontamination process.

FIG. 3 shows the operating sequence when the decontamination or sterilization process is done automatically.

When mail is delivered and the box door is opened then closed, the process start switch 18 is operated, sending a signal to the controller 30 to begin the sterilization process after a delay, determined by the position of the delay knob 38. Following the delay, the processor activates the door lock 14 and the circulation fan 24. The door safety switch 16 signals the controller 30 to stop the process immediately if the door 10 is opened. The ultraviolet sensor 22 provides an indication to the controller 30 if the lamp is not functioning during the decontamination process, signaling the controller to activate the external status lamp 42, producing a visible indication of the failure. The controller determines the process time and after that interval it switches off lamp and fan and unlocks the lock 14.

Figure 4:
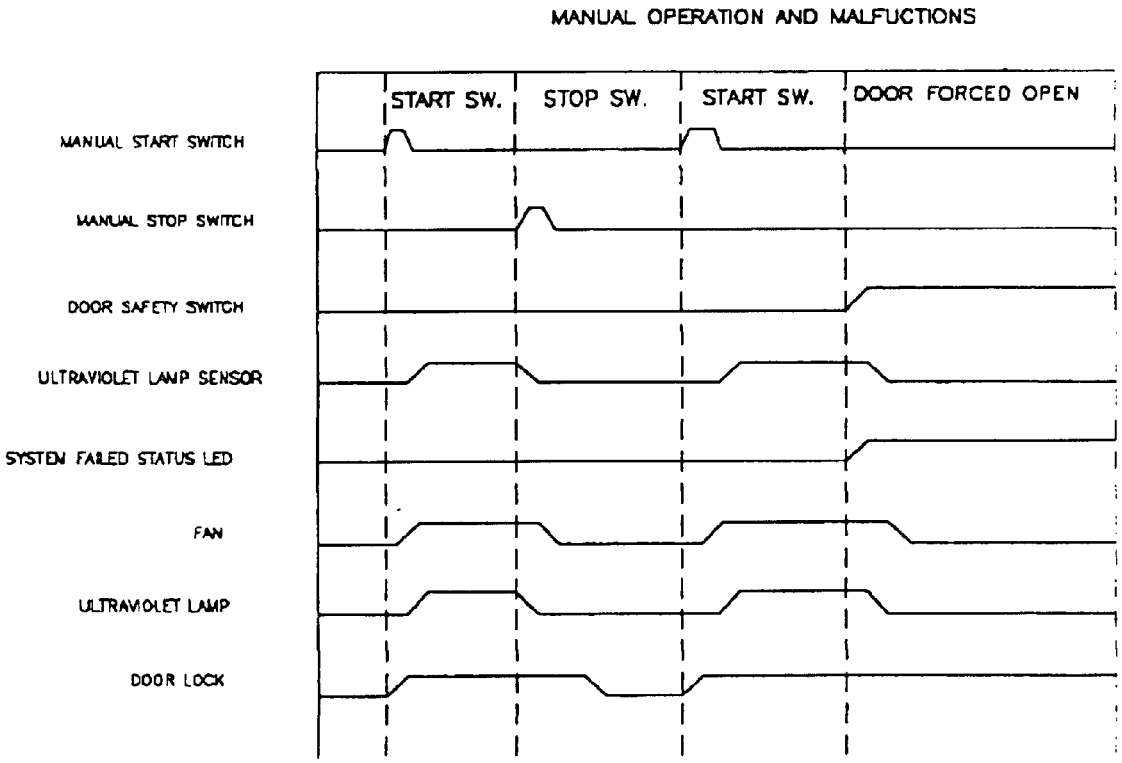
FIG. 4 is a timing diagram showing a manual decontamination process.

FIG. 4 shows the sequence for starting and stopping the processing manually by the operating the external switches 34, 36. It illustrates that manual operation also activates the door lock 14 when the process starts and utilizes the safety switch 16 and sensor lamp 22 in the same way as the automatic operation, to stop the process if the door is opened for some reason.

Ultra violet radiation in the 200–300 nanometer range is known to be extremely effective in destroying microorganisms such as an airborne and surface bacteria viruses, yeast and mold. Low-pressure light sources such as Mercury-arc germicide lamps are designed specifically to radiate mostly UV, typically radiating about 90 percent of the total radiated energy in the 253.7 nanometer range, which is close to the peak of the germicidal curve at 265 nanometers, considered the most lethal wavelength to microorganisms. Light source germicidal lamps have been successfully employed in an air and water purification in the food, beverage and medical industries. Light sources designated "VH" germicidal lamps produce energy at 185 nanometers wavelength as well, which is known to produce abundant amounts of ozone. Ozone, an extremely effective deodorizer, destroys microorganisms on contact, and being airborne, it can be forced into places that UV radiation alone will not reach. The lamp described above is therefore preferably the "VH" type, the fan 24 providing air circulation to distribute ozone throughout the box's interior.

One skilled in the art may make modifications, in whole or in part, to a described embodiment of the invention and its various functions and components without departing from the true scope and spirit of the invention.

What is claimed is:

1. A system for decontaminating mail comprising:

a mail box;

a mail box door on the mail box;

a door lock;

means for operating the door lock in response to a door lock signal to lock the door;

means for providing a first signal when mail has been inserted into the mailbox;

means for decontaminating contents of the mail box; and controls means, activated by the first signal, that in response thereto, produces, for a time interval, said door lock signal, generates a predetermined delay time, and following the predetermined delay time, operates the decontaminating means.

2. The system described in claim 1, wherein the means for decontaminating comprises a source of ultra violet light and ozone.

3. The system described in claim 1, wherein the means for decontaminating comprises a source of ultra violet light and ozone.

4. The system described in claim 3, further comprising:

means for manually activating and deactivating said control means.

5. The system described in claim 3, further comprising means for providing an error signal indicating that the source is not operating.

6. The system described in claim 5 wherein said means for providing a error signal comprises means for detecting UV.

7. A method for using a system for decontaminating mail, wherein the system comprises a mail box, a mail box door on one end of the mail box, a decontamination device in the interior of the mail box, and an electronic lock on the mail box door, the method comprising:

sensing the closing of the mail box door;

generating a first signal when mail has been inserted in the mailbox;

generating a predetermined time delay in response to the first signal;

activating the decontamination device in the interior of the mail box for a time interval when the door is closed and after the predetermined time delay;

activating the electronic lock on the door while the device is activated; and deactivating the electronic lock after the time interval expires.

8. The method of claim 7, wherein said device produces UV and ozone.

9. The method of claim 8, further comprising providing indications of the status of the device.

10. The method of claim 9, wherein providing indications of the status of the device comprises sensing UV in the interior of the mailbox.

11. A system for decontaminating mail comprising:

a mail box;

a mail box door on the mail box;

a door lock;

means for operating the door lock in response to a door lock signal to lock the door;

means for providing a first signal when mail has been inserted into the mailbox;

means for decontaminating contents of the mailbox; and controls means, activated by the first signal, that, in response thereto: (i) produces for a time interval said door lock signal, (ii) generates a predetermined time delay, (iii) after the predetermined time delay, operates the decontaminating means; and (iv) unlocks door lock after the time interval has expired.

* * * * *